US011480313B2

(12) United States Patent
Hawks

(10) Patent No.: US 11,480,313 B2
(45) Date of Patent: Oct. 25, 2022

(54) VEHICLE LAMP

(71) Applicant: North American Lighting, Inc., Paris, IL (US)

(72) Inventor: Paul Christopher Hawks, Hazel Park, MI (US)

(73) Assignee: NORTH AMERICAN LIGHTING, INC., Paris, IL (US)

( * ) Notice: Subject to any disclaimer, the term of this patent is extended or adjusted under 35 U.S.C. 154(b) by 0 days.

(21) Appl. No.: 16/876,899

(22) Filed: May 18, 2020

(65) Prior Publication Data

US 2020/0363035 A1 Nov. 19, 2020

Related U.S. Application Data

(60) Provisional application No. 62/849,784, filed on May 17, 2019.

(51) Int. Cl.

| | |
|---|---|
| ***F21S 45/00*** | (2018.01) |
| ***F21S 45/47*** | (2018.01) |
| ***F21S 41/32*** | (2018.01) |
| ***F21S 41/147*** | (2018.01) |
| ***F21S 41/33*** | (2018.01) |
| ***F21S 41/145*** | (2018.01) |
| *F21Y 115/10* | (2016.01) |

(52) U.S. Cl.

CPC ..... *F21S 45/47* (2018.01); *F21S 41/145* (2018.01); *F21S 41/147* (2018.01); *F21S 41/321* (2018.01); *F21S 41/336* (2018.01); *F21Y 2115/10* (2016.08)

(58) Field of Classification Search

CPC .. F21S 45/47; F21S 41/32; F21S 41/14; F21S 41/145; F21S 41/19; F21S 41/321; F21Y 2115/10

See application file for complete search history.

(56) References Cited

U.S. PATENT DOCUMENTS

| | | | | |
|---|---|---|---|---|
| 6,722,777 | B2 | 4/2004 | Erber | |
| 7,246,921 | B2 | 7/2007 | Jacobson et al. | |
| 9,188,297 | B2 * | 11/2015 | Naganawa | F21S 41/147 |
| 9,322,517 | B2 | 4/2016 | Chu et al. | |
| 9,625,117 | B2 | 4/2017 | Saito | |
| 10,578,267 | B2 | 3/2020 | Bowles et al. | |
| 2003/0227774 | A1 * | 12/2003 | Martin | F21S 41/151 362/240 |
| 2006/0013004 | A1 | 1/2006 | Coushaine et al. | |
| 2009/0290349 | A1 * | 11/2009 | Chu | F21V 29/51 362/249.02 |

(Continued)

FOREIGN PATENT DOCUMENTS

JP 2013131316 A 7/2013

*Primary Examiner* — Gerald J Sufleta, II
(74) *Attorney, Agent, or Firm* — Brooks Kushman P.C.

(57) ABSTRACT

A vehicle lamp is provided having a heat sink having a first end mounted to a lamp housing and having a free distal end extending into a light chamber adjacent a central optical axis of the lamp. A light emitting diode (LED) is mounted adjacent the distal end of the heat sink to have a central light emitting axis opposite the optical axis of the lamp. A parabolic reflector is positioned rearward of the heat sink, a parabolic reflective surface extending at an upper and lower solid angle relative to the LED, wherein the upper and lower combined solid angle is greater than a half-paraboloid.

20 Claims, 5 Drawing Sheets

(56) References Cited

U.S. PATENT DOCUMENTS

| | | | | |
|---|---|---|---|---|
| 2012/0201040 | A1* | 8/2012 | Naganawa | F21S 41/147<br>362/487 |
| 2013/0026922 | A1 | 1/2013 | Allen et al. | |
| 2016/0010809 | A1 | 1/2016 | De Bevilacqua | |
| 2016/0047520 | A1* | 2/2016 | Suzuki | F21S 41/635<br>362/514 |
| 2016/0258589 | A1* | 9/2016 | Ahn | F21S 41/16 |
| 2017/0370543 | A1* | 12/2017 | Matsumoto | F21S 41/30 |
| 2018/0372294 | A1* | 12/2018 | Inoue | F21V 29/503 |

* cited by examiner

VEHICLE LAMP

CROSS-REFERENCE TO RELATED APPLICATIONS

This application claims the benefit of U.S. provisional application Ser. No. 62/849,784 filed May 17, 2019, the disclosure of which is hereby incorporated in its entirety by reference herein.

TECHNICAL FIELD

Vehicle lamps may use a semiconductor light emitting device, such as a light emitting diode (LED) as the light source to provide output light pattern. Typically, LEDs are mounted so the LED emits light generally orthogonal to the output optical axis of the lamp. One example of a vehicle lamp using LED is disclosed in U.S. Pat. No. 10,578,267 by North American Lighting, Inc.

BACKGROUND

According to one embodiment, a vehicle lamp is provided having a heat sink. The heat sink has a first end mounted to a lamp housing and having a free distal end extending into a light chamber adjacent a central optical axis of the lamp. A light emitting diode (LED) is mounted adjacent the distal end of the heat sink to have a central light emitting axis opposite the optical axis of the lamp. A parabolic reflector is positioned rearward of the heat sink, a parabolic reflective surface extending at an upper and lower solid angle relative to the LED, wherein the upper and lower combined solid angle is greater than a half-paraboloid.

SUMMARY

According to one embodiment, a vehicle lamp is provided having a heat sink. The heat sink has a first end mounted to a lamp housing and having a free distal end extending into a light chamber adjacent a central optical axis of the lamp. A light emitting diode (LED) is mounted adjacent the distal end of the heat sink to have a central light emitting axis opposite the optical axis of the lamp. A parabolic reflector is positioned rearward of the heat sink, a parabolic reflective surface extending at an upper and lower solid angle relative to the LED, wherein the upper and lower combined solid angle is greater than a half-paraboloid.

In at least one embodiment, the upper and lower solid angles combine to form a full-paraboloid.

In another embodiment, the upper solid angle and lower solid angle are generally equal.

In at least one embodiment, the heat sink has a plurality of fins extending into the lamp chamber.

In another embodiment, the fins each have at least two conductive surfaces generally extruded parallel to the optical axis and spaced apart so air passing around these two surfaces provides convective heat dissipation from the heat sink.

In at least one embodiment, the parabolic reflector has one or more truncated edges.

In another embodiment, the heat sink is oriented at an angle so the distal end of the heat sink is closer to the reflector.

According to one embodiment, a vehicle lamp is provided having a heat sink extending as a pillar from a periphery of the lamp chamber and having a free distal end. A light emitting diode (LED) is mounted adjacent the distal end of the heat sink along a rear surface of the heat sink. A parabolic reflector is positioned rearward of the heat sink, a parabolic reflective surface extending at an upper and lower solid angle relative to the LED, wherein the upper and lower combined solid angle is greater than $\pi$.

In at least one embodiment, the heat sink has a plurality of fins projecting from a forward surface opposite the rear surface.

In another embodiment, the fins are provided on the front surface of the heat sink and extend along a length of the heat sink from the LED to the periphery of the lamp chamber.

In at least one embodiment, the parabolic reflective surface is a free form surface that reflects the light generally parallel to the optical axis of the lamp.

In another embodiment, the heat sink is visible through a forward opening of the lamp. The LED is not visible through the forward opening.

According to one embodiment, a vehicle lamp is provided having a heat sink. The heat sink has a first end mounted to a lamp housing and having a free distal end extending into a light chamber adjacent a central optical axis of the lamp. A light emitting diode (LED) is mounted adjacent the distal end of heat sink to have a central light emitting axis opposite the optical axis of the lamp. A parabolic reflector is positioned rearward of the heat sink, a parabolic reflective surface extending at an upper angular sweep above the LED and a lower angular sweep below the LED.

In at least one embodiment, a light shade to block a portion of the light from the LED is integrally formed in the heat sink.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Current LED reflector designs for vehicle forward lighting are built around the concept of placing an LED at the parabolic focus of a reflector. The LED emits light orthogonal to the optical axis with the circuit board and heat sink resting in the horizontal plane. This only allows for half of a paraboloid to be used to collect light as the board and heat sink cut the paraboloid. This limits efficiency and necessitates performance lamps to have either vertically expansive reflectors (to improve efficiency) or to use multiple reflector cavities (more LEDs, larger heat sink). Both cases are problematic as lamp packaging conditions typically inhibit reflector geometry and increasing the number of cavities typically leads to higher cost, diminished efficiency, a poor thermodynamic environment, increased glare, and the need for design restriction to prevent cavity "cross-talk", in which and LED from one cavity is able to shine light upon facets from an adjacent cavity (glare concern).

Figure 1:
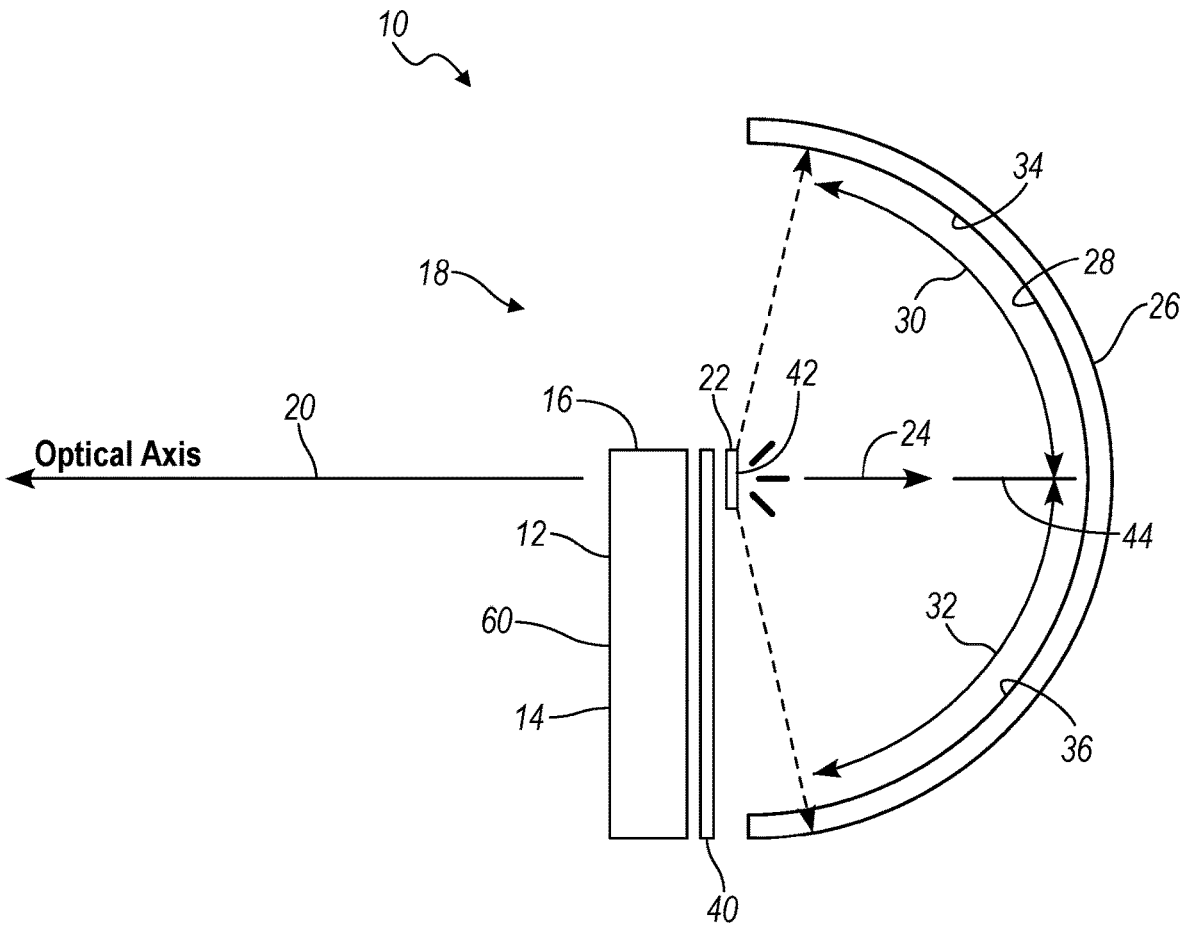
FIG. 1 is a schematic view of a lamp according to one embodiment of the present application.

FIG. 1 illustrates a section through a vehicle lamp 10 having a heat sink 12. The heat sink 12 may be mounted to a light housing at a first end 14. A distal end 16 extends into a light chamber 18 toward a central optical axis 20. The central optical axis 20 for the vehicle lamp 10 is defined as the forward direction, regardless of the orientation of the lamp 10 in a vehicle. The distal end 16 may be adjacent the optical axis 20. In at least one embodiment, the heat sink 12 does not extend past the optical axis 20 to ensure the heat sink 12 does not block light reflected from the reflector. As illustrated in FIG. 1, the first end 14 of the heat sink 12 is located at the bottom of the lamp chamber 18. However, the heat sink 12 may be mounted to extend from an upper portion of the light chamber or side portions of the lamp chamber. The central optical axis 20 for the vehicle lamp 10 is defined as the forward direction, regardless of the orientation of the lamp 10 in a vehicle.

A circuit board 40 is mounted to the heat sink 12. The circuit board 40 is mounted on the rearward side of the heat sink. A light emitting diode (LED) 22 is mounted to the rearward side of the circuit board adjacent to the distal end of heat sink and positioned to have a central light emitting axis 24 opposite the optical axis 20 of the lamp 10. The LED 22 emits a hemisphere of light which has the central light emitting axis 24 which is orthogonal to the surface of the LED 22. The LED's central light emitting axis 24 intersects the LED 22 at a LED focal point 42. LEDs may also be directly mounted to the heat sink, eliminating the need for the circuit board.

The heat sink 12 is formed of a thermally conductive material such as aluminum or magnesium so that the heat generated by the LED 22 is transmitted to the adjacent board 40, which then transmits the heat to the adjacent heat sink 12. In the event of direct-mounted LEDs to the heat sink 12, heat transfer would be directly from LED to the heat sink material.

A parabolic reflector 26 is positioned rearward of the heat sink and has a parabolic reflective surface 28 extending at an upper and lower solid angle 30, 32 relative to the LED 22. The focal point of parabolic reflector surface 28 aligns with the LED focal point 42. The linear distance between LED focal point 42 and the parabolic reflective surface 28 is commonly known as the focal distance. The light emitted from the LED 22 that is incident on the parabolic reflective surface 28, is reflected such that it changes direction to be parallel to the central optical axis 20. In other embodiments, the optical design may be modified so that the parabola reflective surface aims the light into different patterns.

A boundary line 44 drawn rearward from the LED focal point 42 and parallel to the central optical axis 20 intersects the parabolic reflective surface 28. The three-dimensional measure of the amount of light from the light source 22 that is incident on the parabolic reflective surface 28 defines the upper solid angle 30 and the lower solid angle 32. The solid angle above the boundary line 44 is an upper solid angle surface 30 and the solid angle below the boundary line 44 is a lower solid angle 32. The parabolic surface 28 is defined by an upper surface 34 and a lower surface 36. As shown in FIG. 1, both the upper surface 34 and lower surface 36 extend from the optical axis 20 to a plane orthogonal to the optical axis 20 about the focal point 42, thus defining a full parabolic surface; the surface being generally hemispherical and having a combined solid angle of approximately $2\pi$. In two-dimensions, the upper and lower angular sweep angle 30, 32 are combined to be approximately 180-degrees. Typical lamps do not approach 180-degrees in two-dimensions, and significantly less than $2\pi$ due to the excessively large depth it would require.

Because there are no obstructions between the LED focal point 42 and the lower solid angle surface 36, the light that is incident on the lower solid angle surface 36 may be reflected to the central optical axis 20. FIG. 1 illustrates the upper solid angle surface 34 and the lower solid angle surface 36 to be the same size, thus the addition of the lower solid angle doubles the parabolic reflective surface 28 compared to a vehicle lamp that does not contain the lower solid angle surface. The increased size of the parabolic reflective surface 28 improves the amount of light that may be collected from the LED 22 and can make 100% light collection an achievable target. Additional light collection allows for longer focal distances to be used. Increased focal distances provide more robust optics for production tolerance and can help provide higher performance lamps due to improved source image size. Improved image size also helps protect performance in non-optimal vehicle aiming conditions. Improvements to robustness for tolerance provide more design freedom, decrease design time, and reduce part maturation time.

Figure 2:
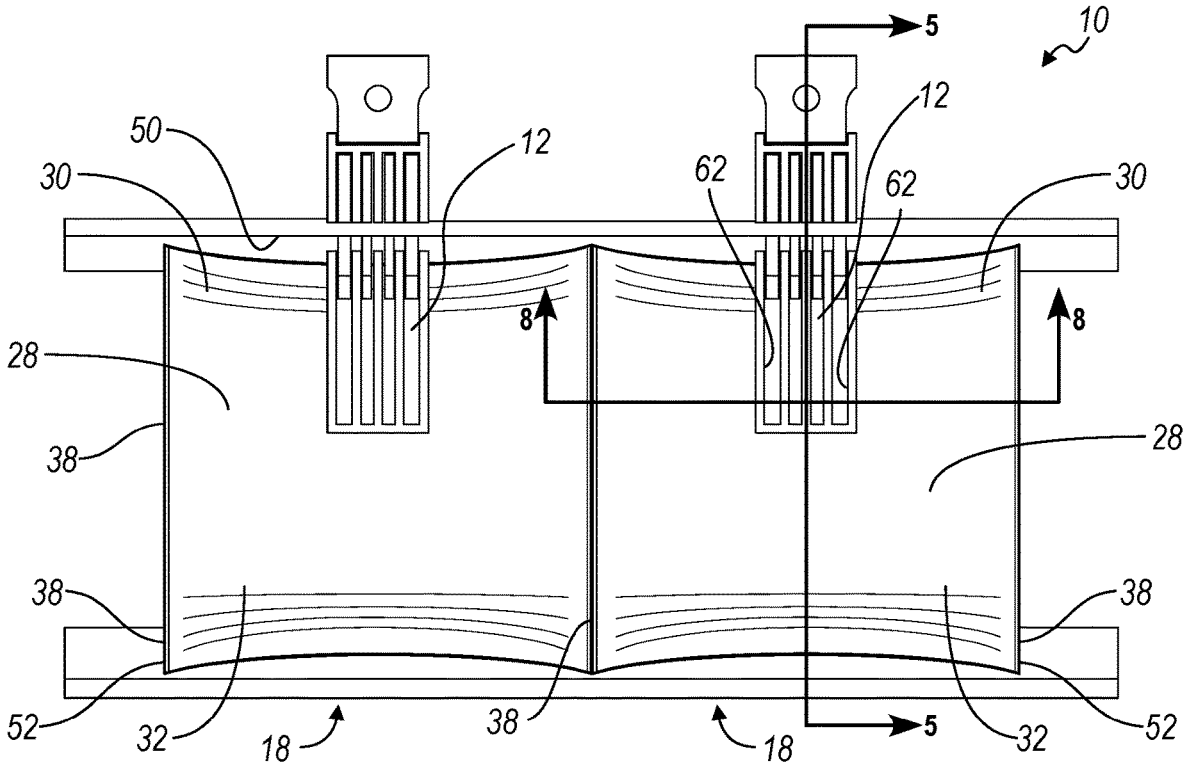
FIG. 2 is a front view of a lamp according to one embodiment of the present application.
Figure 3:
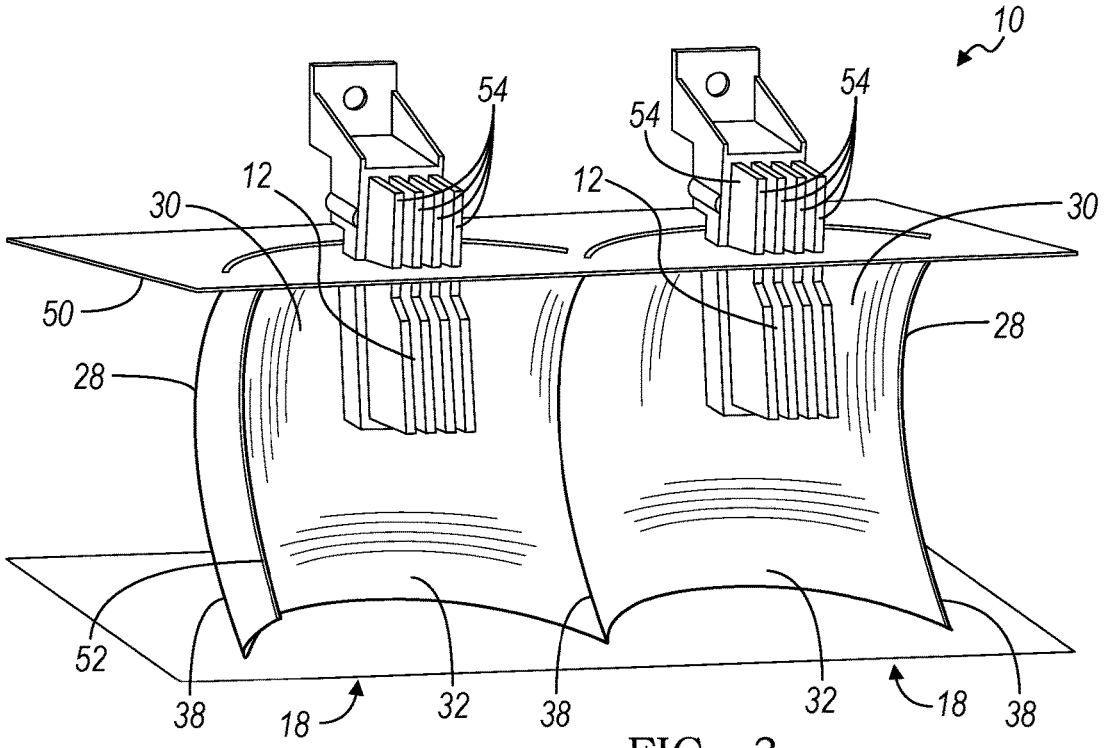
FIG. 3 is a front perspective view of a portion of the lamp of FIG. 2.

FIGS. 2 and 3 illustrate a front view and an isometric view of the vehicle lamp 10 wherein two lamp chambers 18 are located adjacent to one another. In this embodiment the parabolic reflective surface 28 is truncated by an upper and lower boundary 50, 52 to allow the lamp chamber 18 to fit inside the vehicle lamp 10 whose size is limited by additional vehicle components. In this illustration, and shown in more detail in FIG. 5, the parabolic reflective surface 28, upper solid angle surface 34 and lower solid angle surface 36 are truncated so that the surfaces do not extend all they way to the plane extending through the LED focal point 42. Additionally, the parabolic reflective surface 28 is truncated along the lateral sides 38. As shown in FIGS. 2 and 3, the first end 14 of heat sink 12 is located at the top of the lamp chamber 18. The heat sink 12 is comprised of a plurality of heat sink fins 54 that are extruded parallel to the central optical axis 20 and extend parallel to each other.

Figure 4:
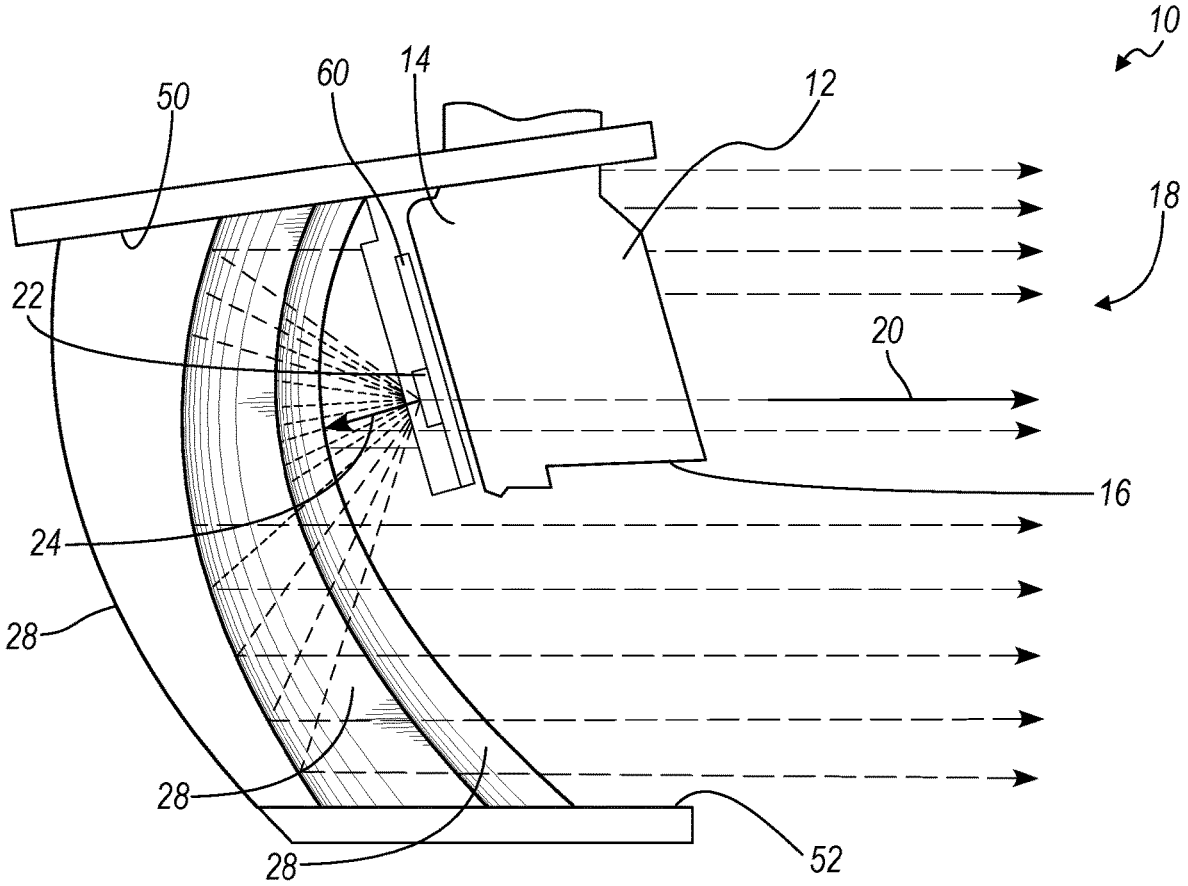
FIG. 4 is a side perspective view of a portion of the lamp of FIG. 2 illustrating light ray traces.
Figure 5:
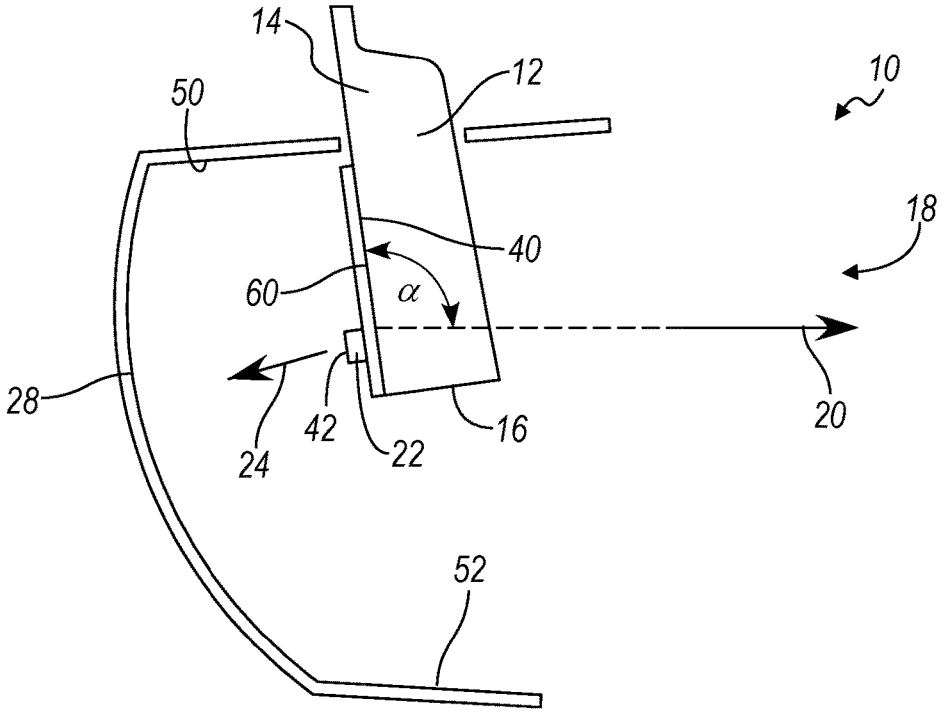
FIG. 5 is a section view through section 5-5 in FIG. 2.

FIGS. 4 and 5 are side views of the vehicle lamp 10 illustrated in FIGS. 2 and 3. It can be seen in this view, and in more detail in FIG. 5, a rear heat sink surface 60 is oriented at an angle A relative to the central optical axis 20. At the angle A, the first end 14 of the heat sink 12 is rearward of the distal end 16. For example, the angle may range from 5-degrees to 20-degrees. The LED 22 mounts to the board 40 which mounts to the rear heat sink surface 60 such that the position of the light emitting axis 24 of LED 22 is declined in the rearward direction.

Figure 6:
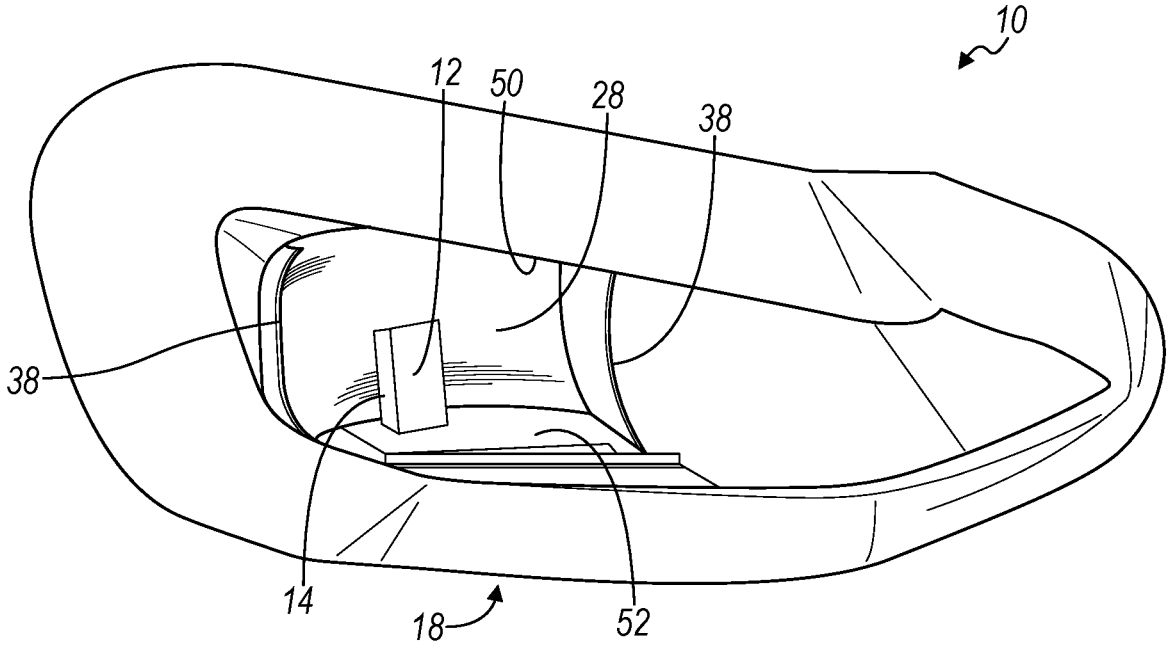
FIG. 6 a front perspective view of a vehicle lamp according to one embodiment of the present application.
Figure 7:
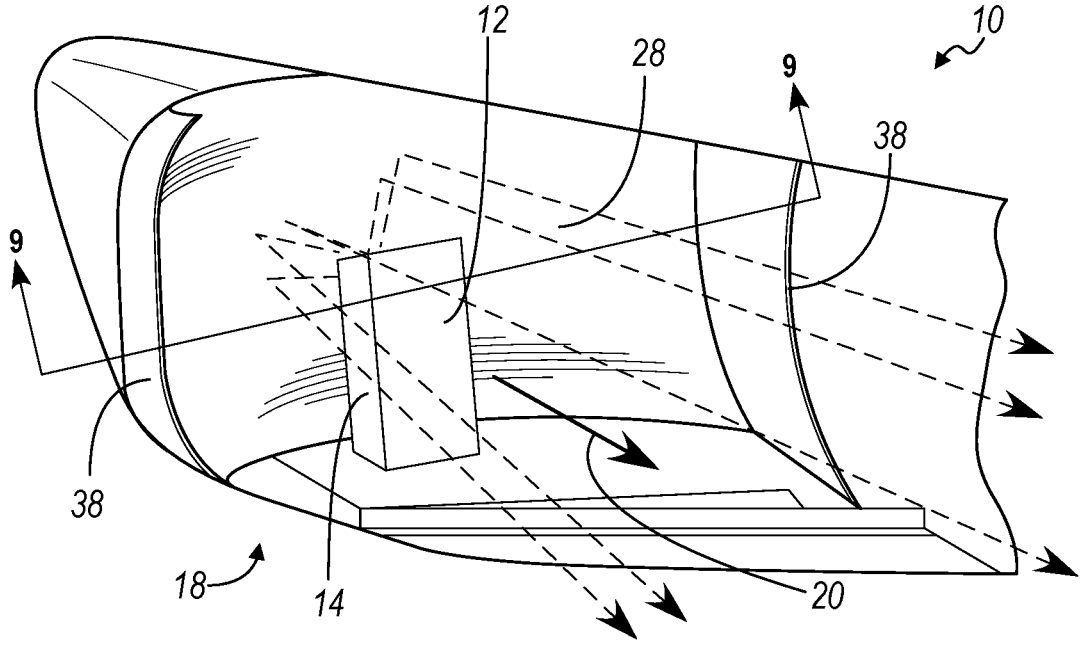
FIG. 7 is a front perspective view of the vehicle lamp of FIG. 6 illustrating light ray traces.

FIGS. 6 and 7 illustrate another embodiment of a vehicle lamp 10 that has a heat sink 12 with the first end 14 at the bottom of the lamp chamber 18.

Figure 8:
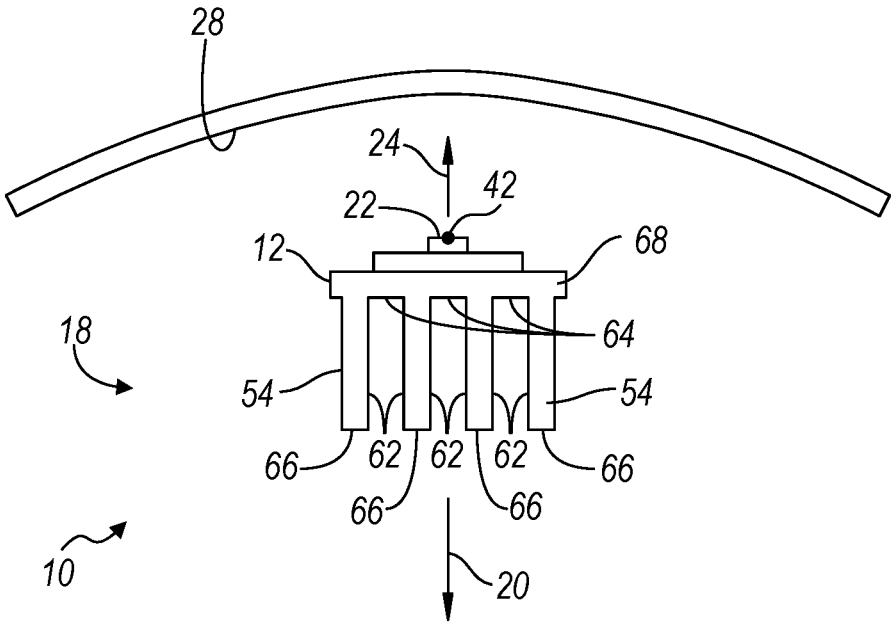
FIG. 8 is a section view through section 8-8 of FIG. 2.

FIG. 8 depicts a horizontal section view through section 8-8 of FIG. 2 and illustrates the detailed construction of heat sink 12. The section is cut through the LED focal point 42 and is generally parallel to the central optical axis 20. Each heat sink fin 54 has a pair of heat sink surfaces 62 extending in the forward direction. The fins 54 are spaced apart by a surface 64 on a base 68 of the heat sink. The fins 54 are spaced apart by the surface 64 to ensure adequate airflow and convective cooling between each of the fins 54. As a forward length of the fins 54 from the base 68 to the front edge 66 increases, the space between the fins 54 by surface 64 increases. This ratio maximizes the convective heat transfer from the heat sink 12.

Figure 9:
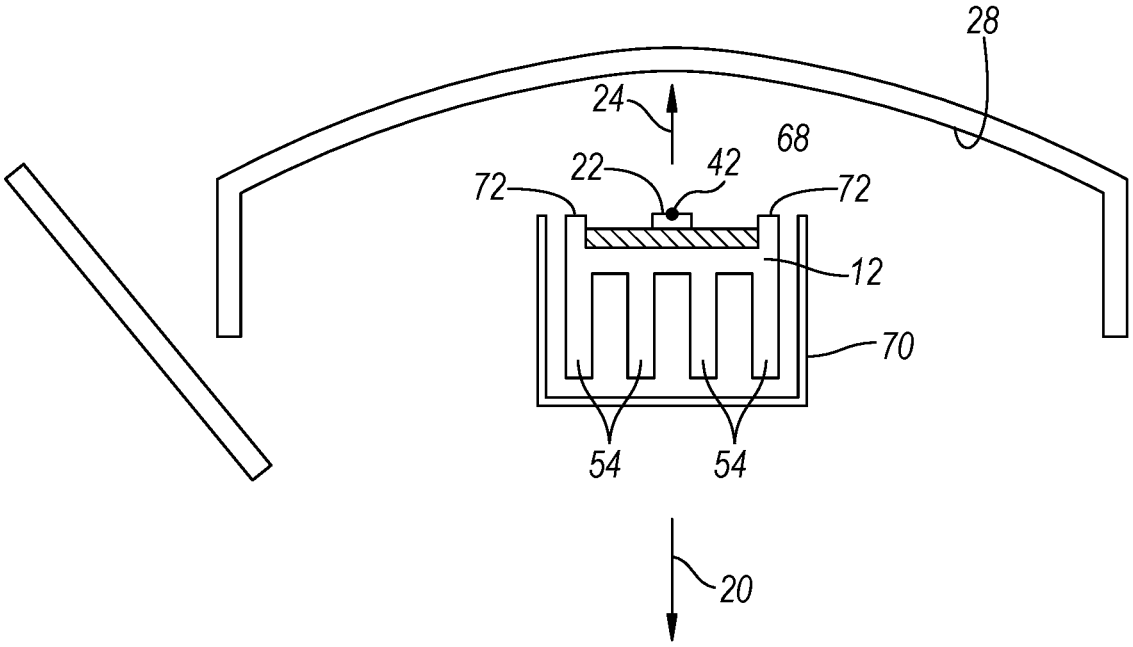
FIG. 9 is a section view through section 9-9 of FIG. 7.

FIG. 9 depicts a horizontal section through section 9-9 of FIG. 7 and illustrates the detailed construction of heat sink 12 with a cover 70. The section is cut through the LED focal point 42 and is generally parallel to the central optical axis 20. In the event of packaging constraint such that an LED light-shade is required, this system more readily allows for a shade portion 72 to be molded into the heat sink 12, alleviating the need for an extra component.

By placing the LED in front of, and emitting light back towards the reflector (vehicle aft), a half paraboloid is no longer necessary as the heat sink and LED board won't cut into the reflector surface. In contrast, a full paraboloid and the new LED orientation, provides the same efficiency in a smaller package and make 100% light collection at the reflector an achievable target within a production sized headlamp, while also allowing for longer focal lengths to be used.

Increased focal lengths provide more robust optics for production tolerance and can help provide higher performance IIHS lamps due to improved source image size. Improved image size also helps protect performance in non-optimal vehicle aiming conditions. Improvements to robustness for tolerance provide more design freedom, decrease design time, and reduce part maturation time.

Moving the heat sink from an enclosed area at the edge of the reflector to an open area in front provides a more thermodynamically advantageous condition, allowing for the use of smaller and more cost-effective heat sinks.

Near 100% light collection at the reflector can entirely shield the LED from visibility, eliminating the need for a separate LED shade, thus making the system robust to stray light (FMVSS/ECE glare regulation). This collection efficiency is not possible to achieve with a conventional half paraboloid in the scale of a normal lamp. In the event of packaging constraint such that an LED shade is required, this system more readily allows for shade material to be molded into the heat sink, alleviating the need for an extra part. LED shades diminish efficiency and increase cost but are necessary in many conventional systems to be regulation compliant. Regulation based glare management is one of the largest hurdles in conventional LED reflector design.

The lamp 10 of the present application provides several advantages. By orienting the heat sink 12 and light source in front of the optical components/reflector (rather than top or bottom) and orienting the optical axis of the LED back toward the reflector (rather than along the vertical as in conventional designs), the LED system can utilize a full paraboloid reflector instead of the conventional half paraboloid. The full paraboloid reflector provides improved efficiency over conventional systems. The location of the heat sink 12 also provides improved thermal condition due to new source location.

The lamp 10 is cost effective in comparison to lamps of similar performance because the lamp has fewer cavities with fewer LEDs, a more cost-effective heat sink, and improved maturation timing. The lamp 10 also provides improved performance potential in relation to modern IIHS safety testing and vehicle aim tolerance. The lamp 10 may also be more robust to manufacturing tolerances than conventional systems.

The lamp 10 provides more efficient headlamps with longer focal lengths. The benefits of this efficiency allow for improved performance while simultaneously diminishing production cost and packaging size. Allowing for longer focal lengths improves the reliability of the part to manufacturing and assembly tolerances while also aiding in making lamp performance more robust to IIHS safety testing and vehicle aiming condition.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle lamp comprising:

at least one lamp chamber comprising:

a heat sink having a first end mounted to a lamp housing and a free distal end extending into an optical chamber adjacent a central optical axis of the lamp;

a light emitting diode (LED) mounted adjacent the free distal end of the heat sink to have a central light emitting axis opposite the optical axis of the lamp;

a parabolic reflector positioned rearward of the heat sink and having a parabolic reflective surface extending at an upper and lower solid angle relative to the LED, wherein the upper and lower combined solid angle is greater than a half-paraboloid and are defined within the optical chamber through which light projects, a lens forming a forward surface of the optical chamber through which light projects along the optical axis, wherein the heat sink is positioned between the LED and the lens within the optical chamber, and wherein the heat sink has a plurality of fins projecting forward toward the lens within the optical chamber.

2. The vehicle lamp according to claim 1, wherein the upper and lower solid angles combine to form a full-paraboloid.

3. The vehicle lamp according to claim 1, wherein the upper solid angle and lower solid angle are generally equal.

4. The vehicle lamp according to claim 1, wherein the at least one lamp chamber comprises a plurality of lamp chambers.

5. The vehicle lamp according to claim 1, wherein the fins each have at least two conductive surfaces and extending forward and spaced apart so air passing around these two surfaces provides convective heat dissipation from the heat sink.

6. The vehicle lamp according to claim 1, wherein the parabolic reflector has one or more truncated edges.

7. The vehicle lamp according to claim 1, wherein heat sink is oriented at an angle so the free distal end of the heat sink is closer to the reflector than the first end.

8. A vehicle lamp of claim 1, wherein the heat sink is formed as a pillar having a length from the periphery of the optical chamber greater than a width.

9. The vehicle lamp according to claim 1, wherein the heat sink is visible through the lens and the heat sink blocks the LED so the LED is not visible through the forward surface.

10. The vehicle lamp according to claim 1, further comprising a light shade to block a portion of the light from the LED, wherein the light shade is integrally formed in the heat sink.

11. A lamp vehicle comprising: at least one lamp chamber comprising:

a heat sink extending from a periphery of an optical chamber to a free distal end positioned within the optical chamber, the heat sink formed as a pillar having a length from the periphery of the optical chamber is greater than a width;

a light emitting diode (LED) mounted adjacent the free distal end of the heat sink along a rear surface of the heat sink;

a lens forming a forward surface of the optical chamber through which light projects; and a parabolic reflector is positioned rearward of the heat sink and having a parabolic reflective surface extending at an upper and lower solid angle relative to the LED, wherein the upper and lower have a combined solid angle being greater than $\pi$ and are defined within the optical chamber through which light projects, wherein the heat sink is positioned between the LED and the lens, and wherein the heat sink has a plurality of fins projecting forward toward the lens, wherein the heat sink is visible through the lens and the heat sink blocks the LED so the LED is not visible through the lens.

12. The vehicle lamp according to claim 11, wherein the fins are provided on a front surface of the heat sink and extend along a length of the heat sink from the LED to the periphery of the optical chamber.

13. The vehicle lamp according to claim 11, wherein the parabolic reflective surface is a free form surface that reflects the light generally parallel to an optical axis of the lamp.

14. The vehicle lamp according to claim 11, wherein the at least one lamp chamber comprises a plurality of lamp chambers.

15. The vehicle lamp according to claim 11, further comprising a light shade to block a portion of the light from the LED, wherein the light shade is integrally formed in the heat sink.

16. A vehicle lamp comprising:

a plurality of lamp chambers, each lamp chamber comprising:

a heat sink having a first end mounted to a lamp housing and a free distal end extending into an optical chamber adjacent a central optical axis of the lamp;

a light emitting diode (LED) mounted adjacent the free distal end of the heat sink to have a central light emitting axis generally opposite the central optical axis of the lamp;

a parabolic reflector positioned rearward of the heat sink and having a parabolic reflective surface extending at an upper angular sweep above the LED and a lower angular sweep below the LED, wherein the upper and lower angular sweep are defined within the optical chamber through which light projects, a lens forming a forward surface of the optical chamber through which light projects along the optical axis, wherein the heat sink is positioned within the optical chamber between the LED and the lens, and wherein the heat sink has a plurality of fins projecting forward toward the lens.

17. The vehicle lamp according to claim 16, further comprising a light shade to block a portion of the light from the LED, wherein the light shade is integrally formed in the heat sink.

18. A vehicle lamp of claim 16, wherein the heat sink is formed as a pillar having a length from the periphery of the optical chamber greater than a width.

19. The vehicle lamp according to claim 16, wherein the plurality of fins projecting forward toward the lens on a front surface of the heat sink and the LED is mounted on a rear surface of the heat sink.

20. The vehicle lamp according to claim 16, wherein the heat sink is visible through the lens and the heat sink blocks the LED so the LED is not visible through the forward surface.

* * * * *